US010051962B2

(12) United States Patent
Goetz

(10) Patent No.: US 10,051,962 B2
(45) Date of Patent: Aug. 21, 2018

(54) DRIVE DEVICE FOR A MOVABLE FURNITURE PART

(71) Applicant: Julius Blum GmbH, Hoechst (AT)

(72) Inventor: Christof Goetz, Lustenau (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 15/134,785

(22) Filed: Apr. 21, 2016

(65) Prior Publication Data

US 2016/0227927 A1 Aug. 11, 2016

Related U.S. Application Data

(63) Continuation of application No. PCT/AT2014/000189, filed on Oct. 22, 2014.

(30) Foreign Application Priority Data

Oct. 25, 2013 (AT) ..... A 824/2013

(51) Int. Cl.
*A47B 88/40* (2017.01)
*A47B 88/46* (2017.01)
(Continued)

(52) U.S. Cl.
CPC ..... *A47B 88/0477* (2013.01); *A47B 88/407* (2017.01); *A47B 88/463* (2017.01);
(Continued)

(58) Field of Classification Search
CPC .... A47B 2210/0016; A47B 2210/0091; A47B 88/453; A47B 88/46; A47B 88/463;
(Continued)

(56) References Cited

U.S. PATENT DOCUMENTS

RE28,646 E * 12/1975 Hedrick ..... C08K 9/06
523/212
4,647,225 A * 3/1987 Grass ..... A47B 88/437
384/10

(Continued)

FOREIGN PATENT DOCUMENTS

CA 2 743 055 12/2012
CN 102573568 7/2012

(Continued)

OTHER PUBLICATIONS

DE102011002212 Translated Description, 9 pages.*

(Continued)

*Primary Examiner* — Andrew M Roersma

(74) *Attorney, Agent, or Firm* — Wenderoth, Lind & Ponack, L.L.P.

(57) ABSTRACT

A drive device for a movable furniture part includes a force-actuated ejection element for ejecting the movable furniture part from a closed position into an open position, and a locking device for locking the ejection element in a locking position. The locking device includes a control element connected to the ejection element, and a gate for the control element. The gate has—outside an optionally present latch depression—sidewall regions that have different hardnesses in certain sections.

20 Claims, 15 Drawing Sheets

(51) Int. Cl.

| | |
|---|---|
| ***A47B 88/47*** | (2017.01) |
| ***A47B 88/57*** | (2017.01) |
| ***A47B 88/04*** | (2006.01) |
| ***A47B 88/407*** | (2017.01) |
| ***A47B 88/463*** | (2017.01) |

(52) U.S. Cl.
CPC ..... *A47B 88/47* (2017.01); *A47B 88/57* (2017.01); *A47B 2210/0091* (2013.01)

(58) Field of Classification Search
CPC ..... A47B 88/467; A47B 88/47; A47B 2088/4675; A47B 88/473; A47B 88/477; A47B 88/40; A47B 88/0477
See application file for complete search history.

(56) References Cited

U.S. PATENT DOCUMENTS

| | | | | |
|---|---|---|---|---|
| 7,641,296 | B2 * | 1/2010 | Le | A47B 88/467 312/319.1 |
| 2003/0199635 | A1 * | 10/2003 | Court | C08G 81/028 525/178 |
| 2003/0233733 | A1 * | 12/2003 | Parker | A47B 95/02 16/415 |
| 2006/0082266 | A1 * | 4/2006 | Le | A47B 88/467 312/319.1 |
| 2013/0193824 | A1 | 8/2013 | Koenig et al. | |

FOREIGN PATENT DOCUMENTS

| | | | | |
|---|---|---|---|---|
| CN | 103153133 | | 6/2013 | |
| DE | 102010017666 | A1 * | 1/2012 | A47B 88/463 |
| DE | 10 2011 002 212 | | 10/2012 | |
| EP | 2 208 440 | | 7/2010 | |
| ES | 2 315 055 | | 3/2009 | |
| JP | 2002-106238 | | 4/2002 | |
| JP | 2012-531991 | | 12/2012 | |
| WO | WO 2007111424 | A1 * | 10/2007 | E05F 5/003 |
| WO | 2011/003738 | | 1/2011 | |
| WO | WO 2012149587 | A1 * | 11/2012 | A47B 88/0477 |
| WO | WO 2013096980 | A1 * | 7/2013 | A47B 88/47 |
| WO | WO 2014170224 | A1 * | 10/2014 | A47B 88/463 |

OTHER PUBLICATIONS

EP2208440 Translated Description, 10 pages.*
ES2315055 Translated Description, 9 pages.*
International Search Report dated Feb. 4, 2015 in corresponding International Application No. PCT/AT2014/000189 (with English translation).
Search Report dated Feb. 27, 2017 in Chinese Patent Application No. 201480058058.X (Partial English translation).

* cited by examiner

DRIVE DEVICE FOR A MOVABLE FURNITURE PART

BACKGROUND OF THE INVENTION

The invention concerns a drive device for a movable furniture part, comprising a force-actuated ejection element for ejecting the movable furniture part from a closed position into an open position and a locking device for locking the ejection element in a locking position, wherein the locking device comprises a control element, which is connected to the ejection element, and a sliding guide path for the control element. Moreover, the invention concerns an article of furniture with a furniture carcass, a movable furniture part movably mounted to the furniture carcass and such a drive device.

Since many years miscellaneous drive devices are produced in the industry of furniture fittings. Opening and/or closing movements of the movable furniture part (drawer, flap, door) are assisted or automatically affected respectively with these drive devices. Particularly known are so-called Touch Latch mechanisms, where an unlocking occurs by pressing onto the movable furniture part, whereupon the drive or ejection device opens the movable furniture part.

Lockable control elements guided in a sliding guide path are particularly suitable for such mechanisms. Mostly, these sliding guide paths are of a heart curve-shape or do have a heart curve-shaped section in which the control element is held or locked in a locking position of the locking device. By over-pressing the movable furniture part in an over-pressing position located behind the closed position, the control element is disengaged from this locking position (latching recess), whereupon the force-actuated ejection element can move freely and ejects the movable furniture part into the opening direction.

Besides the purely mechanical or functional requirements for such drive devices, the requirements regarding the operator convenience and the ease of use are increasing in recent times. There, an import aspect is also the noise development which is pretty high in numerous currently known drive devices. Among other things this is ascribed to the fairly high acting forces and also to the play between the moving components. The source for the noise development among other things is the touching or strong bumping of the control element on the sliding guide path, especially on the sidewalls of the sliding guide path.

Now the object of the present invention is to provide an improved drive device in relation to the state of the art. Particularly, the noise development should be reduced.

That object is attained by a drive device with the features discussed below. Thus, according to the invention it is provided that the sliding guide path—outside an optionally present latch recess—has differently hard sidewall regions in certain areas. These differently hard sidewall regions are enabling to implement the sliding guide path in such a way that those sidewall regions are provided with an appropriate different hardness or surface design, where a particularly high noise development is determined in the area of the sliding guide path.

There are indeed publications which show a resilient latch recess, for example the resilient leg of the spring element in the latch recess region of the DE 10 2011 002 212 A1 or the resilient stopping element as a part of the latch recess of the CA 2 743 055 A1. This resilience, however, solely serves to enable an unlocking by pulling into opening direction and not for preventing noise emergence. In contrast, the sliding guide path of the drive device according to the invention comprises—expressed in other words—in certain areas differently hard sidewall regions, wherein, if the sliding guide path comprises a latch recess, these differently hard sidewall are provided outside of this latch recess.

Particularly preferred it can be provided that the sliding guide path has at least one hard sidewall region and at least one soft sidewall region. Thus, the soft sidewall region serves as a stop for the control element in the particularly stressed or noise-prone sections. These sections are especially found where the sliding guide path has a large guiding function for the control element. In the other sections where only a small guiding function is necessary—this means where the control element by itself without guiding moves almost exactly along the sliding guide path—the sidewall region can be formed hard.

The whole sliding guide path can be composed of different parts. It can also be present as a separate component of the drive device. Particularly preferred it can be provided that the sliding guide path is provided in a carrier made of plastic, preferably made of polycaprolactam, wherein the sidewall regions are at least partly made of the material of the carrier itself. Particularly preferred the plastic of the carrier is an injection-molded part. As an alternative to the production out of polycaprolactam this carrier can also consist of comparable thermoplastics or semi-crystalline thermoplastics. Also plastic composites are possible.

For establishing the soft sidewall regions in principle two variants can be used. These variants can also be present mixed in a single sliding guide path. Thus, according to the first variant it can be provided that the of the sidewall region itself is softer and therefore more resilient. This is so to speak a "material-based" variant for establishing a soft sidewall region. There is, however, also the possibility of "geometrically" establishing a softer sidewall region. In this case the material itself does not have to be softer than for example in the hard sidewall regions, but the sidewall is resilient by a thinner formation of the sidewall and therefore the sidewall is "soft" and also formed resilient when impacting on the side element.

BRIEF SUMMARY OF THE INVENTION

According to a first embodiment it is provided that the at least one soft sidewall region is made of a rubber-elastic material, preferably an elastomer. Particularly preferred a thermoplastic polyurethane is used. Also material composites are possible. Particularly preferred it is provided that the at last one soft sidewall region is formed as an overlay which is separate from the carrier. This means that this overlay is attached as a separate component to the carrier and forms the sliding guide path. Especially it can be provided that the at least one soft sidewall region has a hardness between 40 and 95 shore type A, preferably between 70 and 80 shore type A. In a test procedure in conformity with the DIN ISO 7619-1 a hardness of 78 shore type A was determined when testing thermoplastic polyurethane. This hardness is the mechanical resistance which is opposed by a material to a harder testing specimen. In other words this hardness is the mechanical resistance which is opposed by the sliding guide path to the mechanical impact of the control element.

For the second embodiment it is preferably provided that the at least one soft sidewall region is formed thin-walled with a wall thickness below 0.6 mm, preferably between 0.5 mm and 0.3 mm. On the side of this soft sidewall region averted from the sliding guide path a clearance or a recess is arranged. The thin sidewall is pushed or bent into this clearance in the case of an impact of the control element.

This clearance is preferably provided elongated and substantially parallel to the surface of the sliding guide path in this soft sidewall region. By this thinner formation of the sidewall, not the material itself is formed softer, but this thin region yields upon an impact of the control element and prevents noise development by the deformation. For enabling a simpler production it is preferably provided that the at least one thin-walled and soft sidewall region is formed in one piece with the carrier.

Basically, the carrier is made of a harder material than the overlay. The hardness of this carrier can be better expressed via the elastic modulus than via a shore value. Therefore, it is preferably provided that the carrier has an elastic modulus between 1.000 and 20.000 MPa, preferably between 4.000 and 6.000 MPa. Preferably the elastic modulus is around 5.000 MPa. The carrier itself can, however, comprise differently hard or elastic regions. Basically it has also to be mentioned that the whole sliding guide path can comprise most diverse kinds and dimensions of elastic modules or hardnesses respectively. Only two different kinds are preferably provided, that is to say a hard section with hard sidewall regions, wherein the elastic modulus is the same in all of these hard sidewall regions. Secondly, a soft sidewall region is provided. Preferably, the shore hardness is the same in all soft sidewall regions made of a rubber-elastic material. In contrast, the also soft but thin-walled sidewall regions preferably comprise the same elastic modulus as the hard sidewall regions, but are formed resilient or elastic due to their geometry. However, these two kinds of soft sidewall regions have in common that the deformation of the soft sidewall region is larger than the deformation of the hard sidewall region in the case of the same impact velocity upon the sidewall. Thus, the soft sidewall region forms a crumple zone upon the impact of the control element. The deformation can be differently within the soft sidewall regions which are differently formed and arranged on different positions. It is substantial that the deformation in each soft sidewall region is always larger than in the hard sidewall regions. Of course provided that there are the same impact velocity and at least a similar impact angle of the control element. With other words the same force impact of the control element effects a smaller deformation in the hard sidewall region than in the soft sidewall region.

Depending on the exact configuration of the whole sliding guide path most diverse path sections can be provided with a soft sidewall region. As already indicated, it is preferably provided that the sliding guide path has deflection areas and impact areas for the control element, wherein the at least one soft sidewall region is provided in these deflection areas or impact areas. These deflection areas or impact areas can especially be found where a high spring force of the control element is acting lateral onto the sidewall of the sliding guide path. In contrast, there are areas in which the force of the control element is acting substantially parallel to the sidewall, so that at most frictional forces occur between the control element and the sidewall. In these areas it is not necessary to configure the sidewall particularly soft.

According to a preferred embodiment of the present invention it can be provided that that the sliding guide path has a latch recess, wherein the control element abuts the latch recess in the locking position of the locking device. Basically, the sliding guide path can of course have a soft sidewall region in this latch recess. However, according to the invention the sliding guide path has differently hard sidewall regions outside this latch recess.

Furthermore, it can preferably be provided that the sliding guide path for the control element comprises a latching section formed by the latch recess, an over-pressing section with a deviating slant, an ejecting section, a shifting section, a bearing section and a tensioning section. Usually no high noise developments are to be feared in the over-pressing section and in the ejecting section. However, such noise developments can occur in the shifting section, in which a shift of the control element between the ejecting section and the tensioning section takes place. Also in a bearing section, in which the control element is held when the movable furniture part is located in freewheel, noise developments can occur when impacting. This can also occur in the tensioning section due to the bent form of the sliding guide path. Thus, it is preferably provided that only the shifting section, the bearing section and the tensioning section have at least one soft sidewall region. This is of an advantage especially because in these sections the deflection areas and the impact areas respectively for the control element are located.

Generally, it can be provided that the ejection element is mounted linearly displaceable at the carrier, wherein the ejection element is force-actuated by an ejection force storage means, preferably a tension spring, which is on the one hand fixed to the carrier and on the other hand fixed to the ejection element.

For a simple possibility to move the control element it is preferably provided that the, preferably peg-formed, control element is arranged on a control lever which is mounted movably, preferably pivotable, to the ejection element.

Further, it is preferably provided that the locking device is unlockable by over-pressing the movable furniture part in an over-pressed position, the over-pressed position (ÜS) being located behind the closed position. Of course, a triggering can also be effected by means of pulling the movable furniture part. However, it is preferably provided that there is no unlocking when pulling the movable furniture part, but the movable furniture part can be simply pulled in opening direction without unlocking the locking device.

In order to not just enable an automatic opening movement a retracting device for retracting the movable furniture part from an open position in closing direction into the closed position is preferably provided, the retracting device preferably being damped by a damping device.

Protection is also claimed for an article of furniture with a furniture carcass, a movable furniture part movably mounted to the furniture carcass and a drive device according to the invention. Here it can be provided that the drive device is associated with the furniture carcass and is acting onto an entrainment member, which is arranged on the movable furniture part, or directly onto the movable furniture part. However, preferably it is provided that the drive device is associated with the movable furniture part and ejects itself from the furniture carcass or from an entrainment member which is fixed to the furniture carcass.

Further details and advantages of the present invention are described more fully hereinafter by means of the specific description with reference to the embodiments illustrated in the drawings, in which:

DETAILED DESCRIPTION

Figure 1:
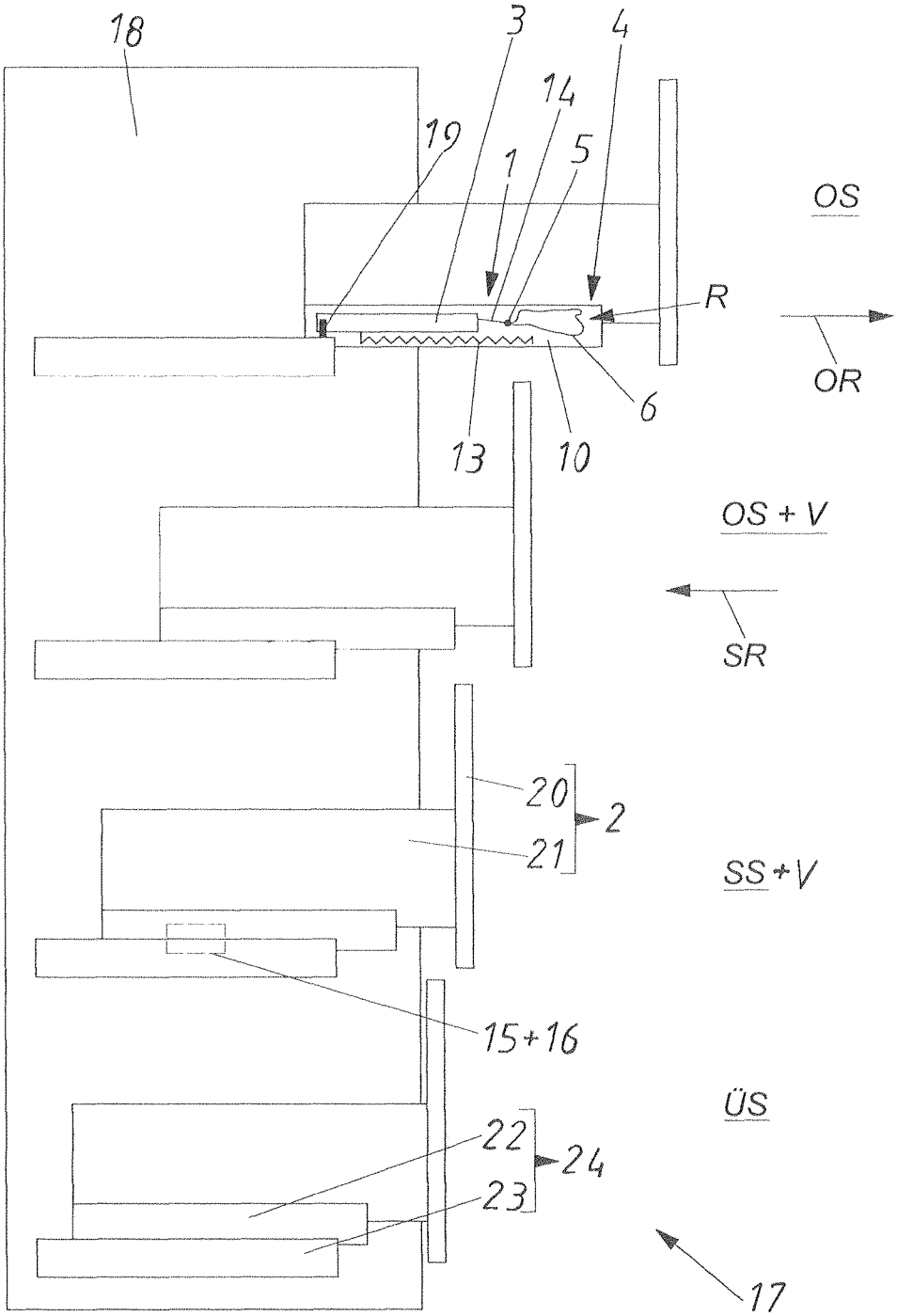
FIG. 1 schematically shows an article of furniture with movable furniture parts in different positions.

FIG. 1 schematically shows an article of furniture 17 consisting of a furniture carcass 18 and several movable furniture parts 2 (drawers). As substantial components the movable furniture parts 2 comprises the drawer box 21 and the front panel 20. The movable furniture part 2 is movably mounted on the furniture carcass 18 via an extension guide 24, wherein the extension guide 24 comprises a carcass rail 23, optionally a center rail (not shown) and a drawer rail 22.

The drive device 1 is fixed via the carrier 10 to the movable furniture part 2 shown at the top and to its drawer rail 22 respectively. The sliding guide path 6 is formed in the carrier 10 and forms together with the control element 5 the locking device 4 for the ejection element 3. The ejection element 3, in turn, can be coupled via the entrainment member 10 to the carcass rail 23 and the furniture carcass respectively. The topmost drawer is located in an open position OS. At the same time the ejection force storage means 13 (in this case a compression spring) relaxes and the ejection element 3 is not locked via the control element 5 in the latching section R of the sliding guide path 6. Rather, the control element 5 is located in a section averted from the latching section R.

If now moving the movable furniture part 2 from this open position OS into closing direction SR (see second drawer from above), so the ejection force storage means 13 is tensioned due to the manual force onto the movable furniture part 2 using the coupling of the ejection element 3 with the entrainment member 19, whereby the control element 5 is moved into the latching section R. Thereby, the locking device 4 is located in the locking position V. This is not apparent from this schematic drawing, but can be comprehend from the later following drawings.

As soon as this locking position V is reached, the only schematically indicated retraction device 16 together with the damping device 15 retracts the movable furniture part 2 into the closed position SS (see third drawer from above). Also in this closed position SS the locking device 4 is locked in the locking position V.

If then, according to the fourth drawer from above, manually pressing onto the movable furniture part 2, the movable furniture part 2 reaches an over-pressed position US located behind the closed position SS, in which unlocking of the locking device 4 occurs. Thereby, the ejection force storage means 13 can relax and the movable furniture part 2 is ejected into opening direction OR, so that the open position OS according to the topmost drawer is reached.

Figure 2:
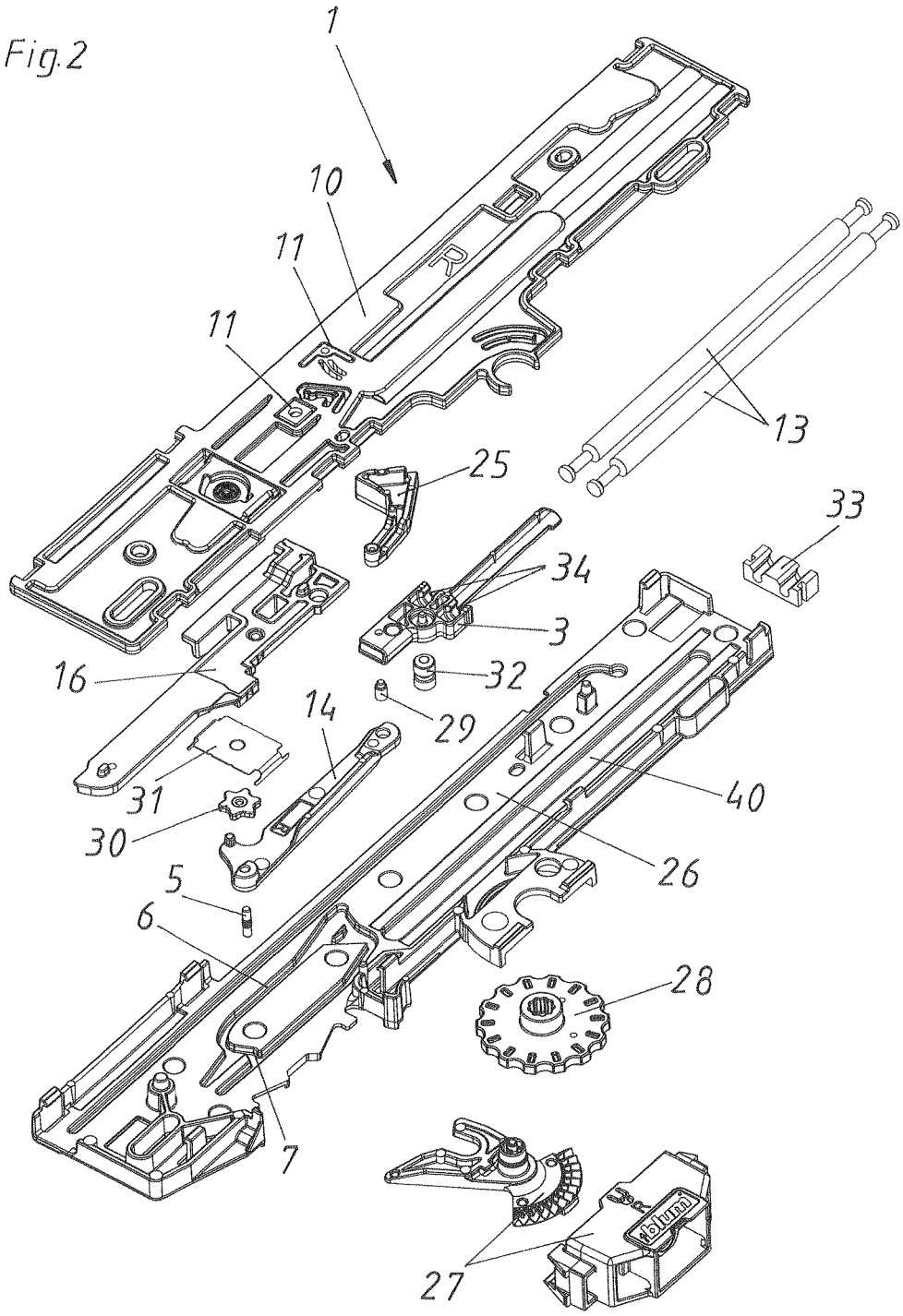
FIG. 2 shows a drive device in explosion view.
Figure 3:
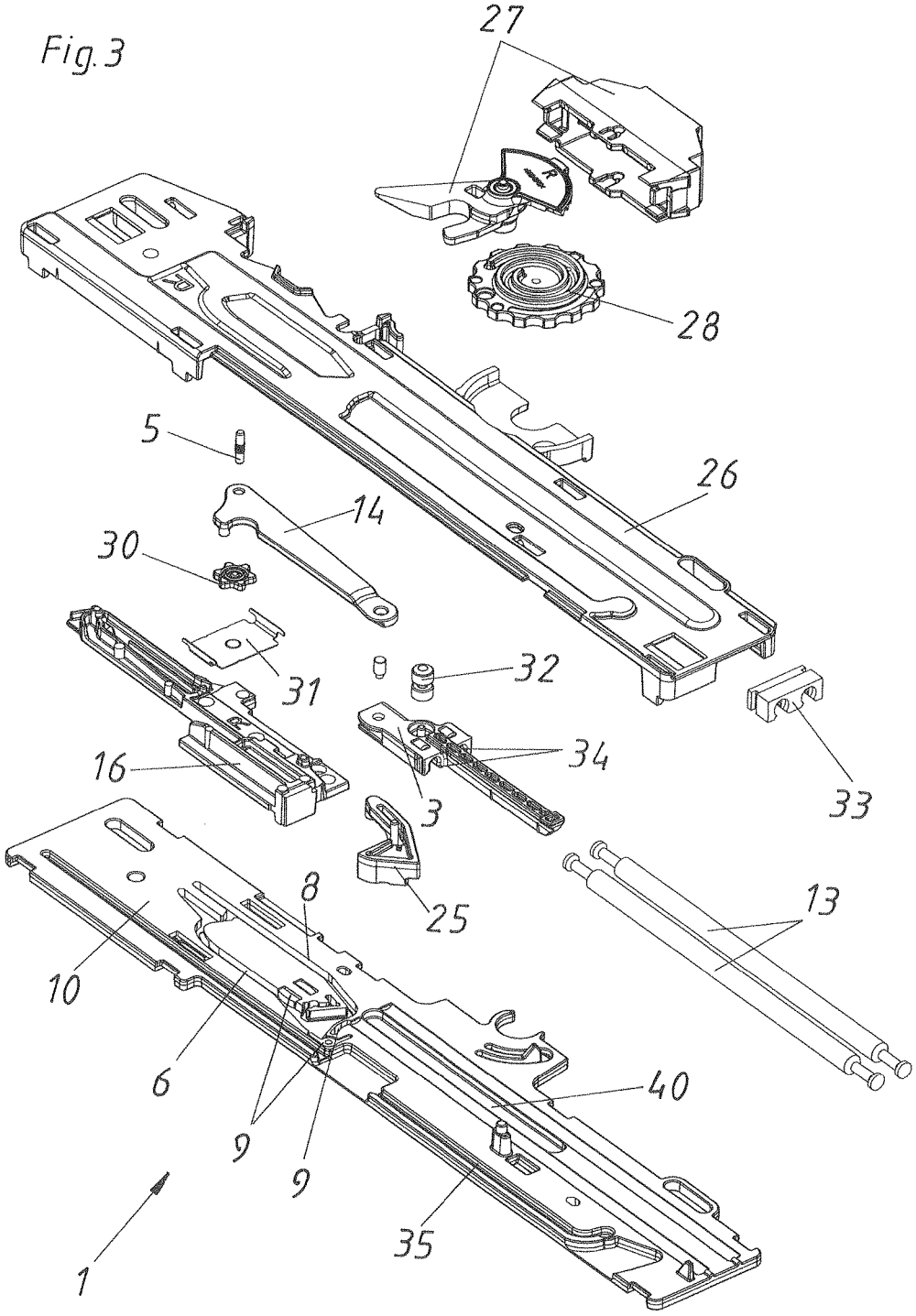
FIG. 3 shows a drive device in explosion view.

A specific embodiment of a drive device 1 is shown in the explosion views according to the FIGS. 2 and 3. According to that the drive device comprises the carrier 10 and the cover 26, wherein the sliding guide path 6 is formed in both components. The carrier 10 and the cover 26 together form the housing of the drive device 1. The ejection slider 3 is mounted linearly movable in this housing and on this carrier 10 respectively. The ejection element 3 is force-actuated by the ejection force storage means 13 (two pull springs). The ejection force storage means 13 is on the one hand connected to the carrier 10 via the spring basis 33 and on the other hand connected via the spring basis 34 to the ejection element 3. The control lever 4 is pivotable mounted to the ejection element 3 via the rotational axis 29. The peg-formed or cylindrically formed control element 5 is arranged on the end of the control lever 4 which is remote from the ejection element 3, wherein this control element 5 is guided in the sliding guide path 6. A guiding roller 32 for the ejection element is also provided in the area of the ejection element, wherein the guiding roller 32 is guided in the guiding path 40 which is formed in the carrier 10 and in the cover 26. The latching damper 30 for the control element 5 is rotary mounted to the carrier 10, wherein the latching damper 30 is held on the carrier 10 by the holder 31. A retraction device 16 with a not shown retraction force storage means is further provided, wherein the retraction device 16 is movably guided in the guide path 35. Also a catch lever 25 is mounted pivotable to this retraction device 16, wherein a coupling with the here not shown entrainment member 19 is effected via this catch lever 25 Further, the components of the synchronization device 27 are shown in these FIGS. 2 and 3, by which a synchronization can be effected with a drive device 1 arranged on the opposite side of the furniture carcass 18. Moreover, a depth adjusting wheel 28 is provided with which the relative position of the housing to the drawer rail 22 and to the movable furniture part 2 respectively can be adjusted.

Figure 4:
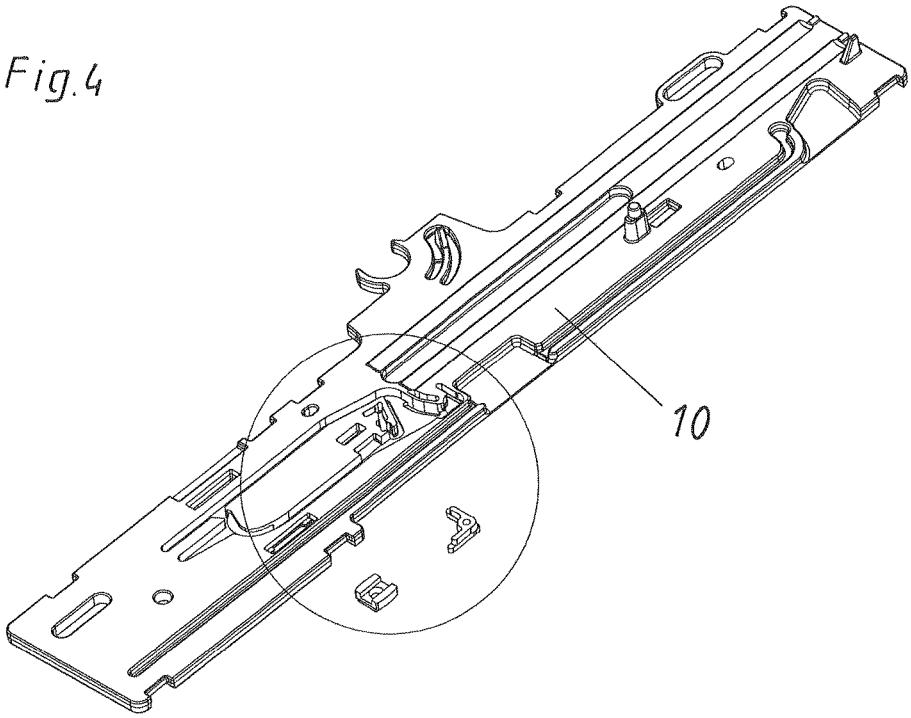
FIG. 4 shows a carrier with the overlays forming the soft sidewall regions.
Figure 4:
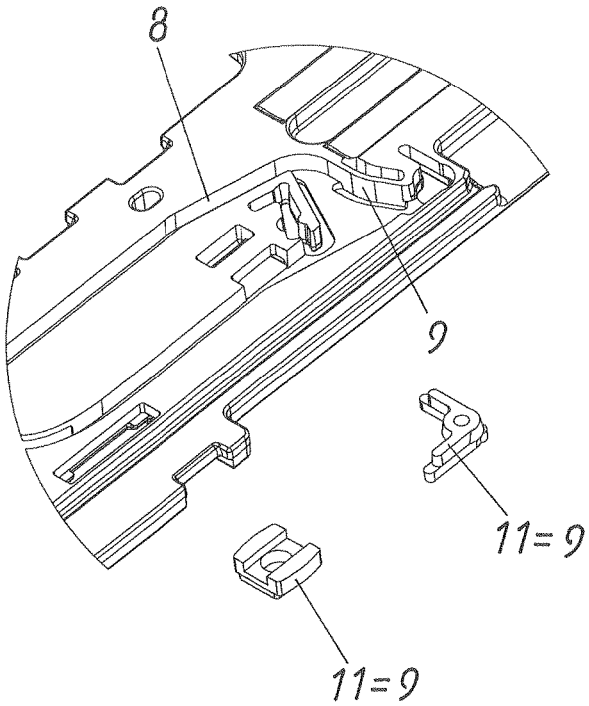

As can already be seen well in the FIGS. 2 and 3, two overlays 11, which are forming the soft sidewall regions 9 of the sliding guide path 6, are arranged on the carrier 10. These overlays 11 are fixed, held and inserted respectively to the carrier 10, for example by positive-locking and/or frictional engagement. As indicated in FIG. 4 the main part of the sliding guide path 6 is formed in one piece with the carrier 10, respectively the carrier 10 forms the main part of the sliding guide path 6. This carrier 10 is injection-molded from a polycaprolactam and thus forms the hard sidewall region 8 of the sliding guide path 6, but also a soft sidewall region 9 can be formed by the polycaprolactam or directly by the carrier 10, wherein in that case a softer stop for the control element 5 is reached by the geometry and a thin wall.

Figure 5:
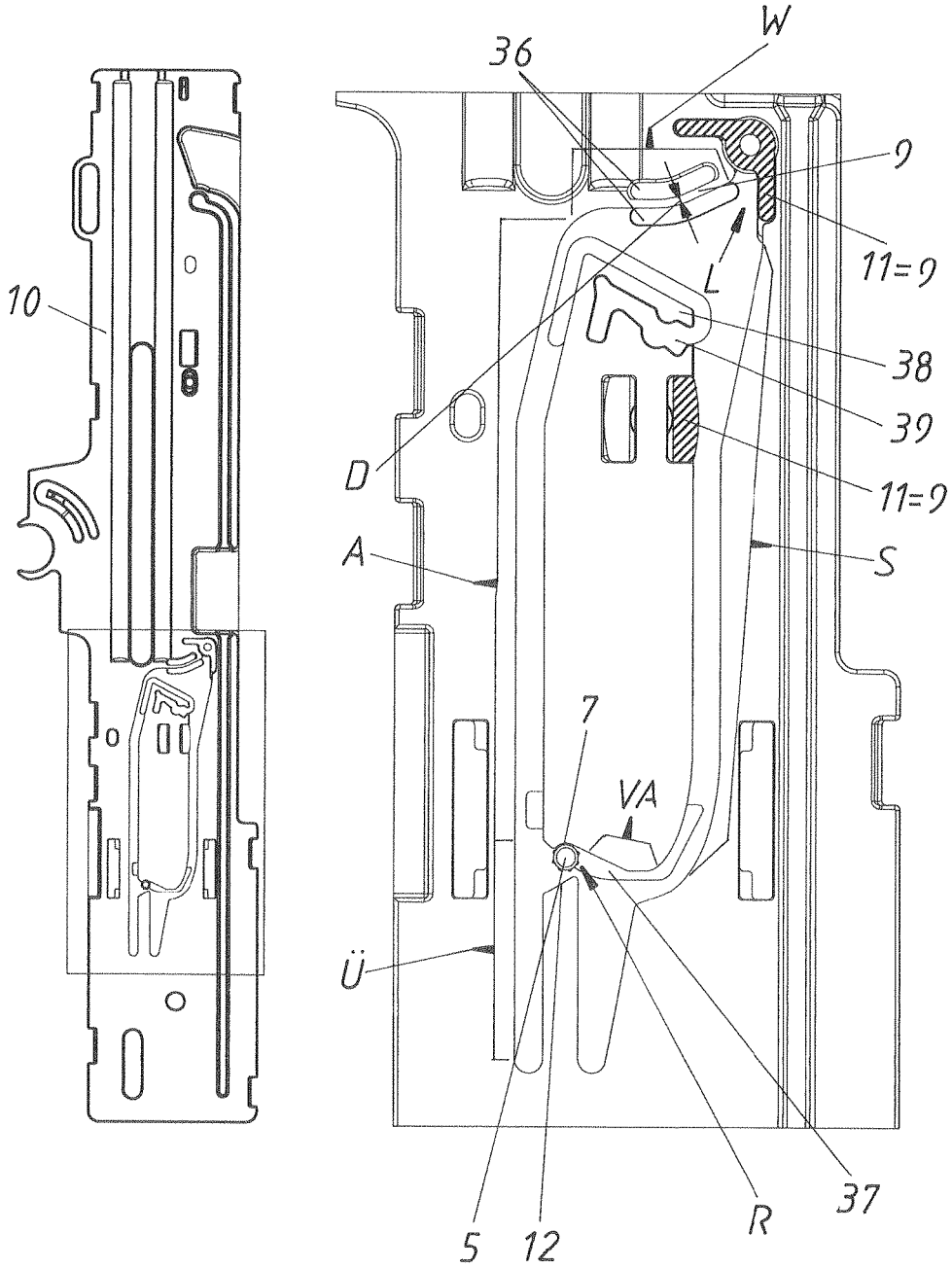
FIG. 5 shows a top view and a perspective illustration respectively of the control element in different sections of the sliding guide path.

The essential sections of the sliding guide path 6 are illustrated in FIG. 5. There, the control element 5 abuts the latching recess 7 of the latching section R. Also a recess 37 is provided in this section, so that an interaction of the control element 5 with the latching damper 30 is possible. By over-pressing the movable furniture part 2 into the over-pressed position ÜS the control element 5 reaches the over-pressing section Ü due to the deviating slant 12. The ejection section A, in which the movable furniture part 2 is ejected, is directly linked to this over-pressing section Ü. After the completion of the ejection process a shift of the control element 5 from the ejection section A to the tensioning section S must be effected. This is reached via the shifting section W which is arranged substantially lateral to the ejection direction. For reaching a subsequent freewheel of the movable furniture part 2, a bearing section L is formed on the end of the sliding guide path 6 which is remote from the latching section. The tensioning section S is linked to this bearing section L. Again the locking section VA follows on this tensioning section S, wherein the locking section VA finally leads to the latching section R. For the present invention it is now substantial that the sliding guide path 6 has differently hard sidewall regions 8 and 9 in certain areas outside the latch recess 7. Thereby, the soft sidewall regions 9 serve to reduce noise development by the impact of the control element 5 onto the sidewalls of the sliding guide path 6. For this purpose the overlays 11 made of a softer material (thermoplastic polyurethane) are arranged in the tensioning section S and in the bearing section L, whereby the noise development is strongly reduced upon an impact of the control element 5 onto these soft sidewall regions 9. The same effect applies to the soft sidewall region 9 in the region of the shifting section W, which is not made of another material, but is formed thin-walled with a wall thickness D below 0.6 mm, preferably between 0.5 mm and 0.3 mm. However, this region of the shifting section W is formed resilient not only due to this thin wall thickness D, also the recesses 36 are necessary for this purpose, so that the whole thin-walled sidewall region 9 can yield upon an impact of the control element 5. Therefore, the impact energy upon an impact of the control element 5 is not fully converted into noise, but also into a deformation, whereby a noise reduction is reached. The element 38 and the recess 39 serve as a deflector for the control element 5 in case of an operating error.

Figure 6:
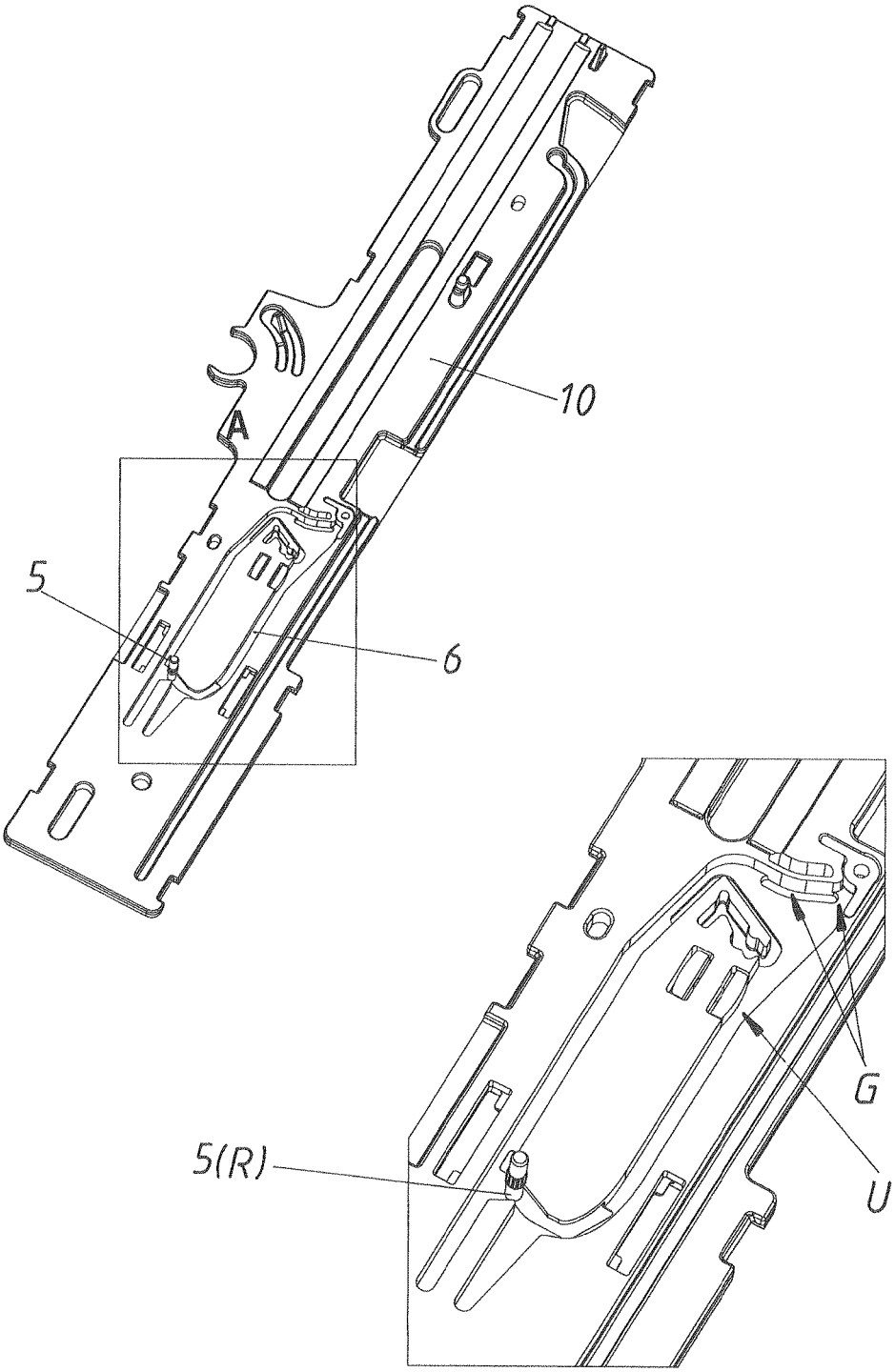
FIG. 6 shows a top view and a perspective illustration respectively of the control element in different sections of the sliding guide path.
Figure 7:
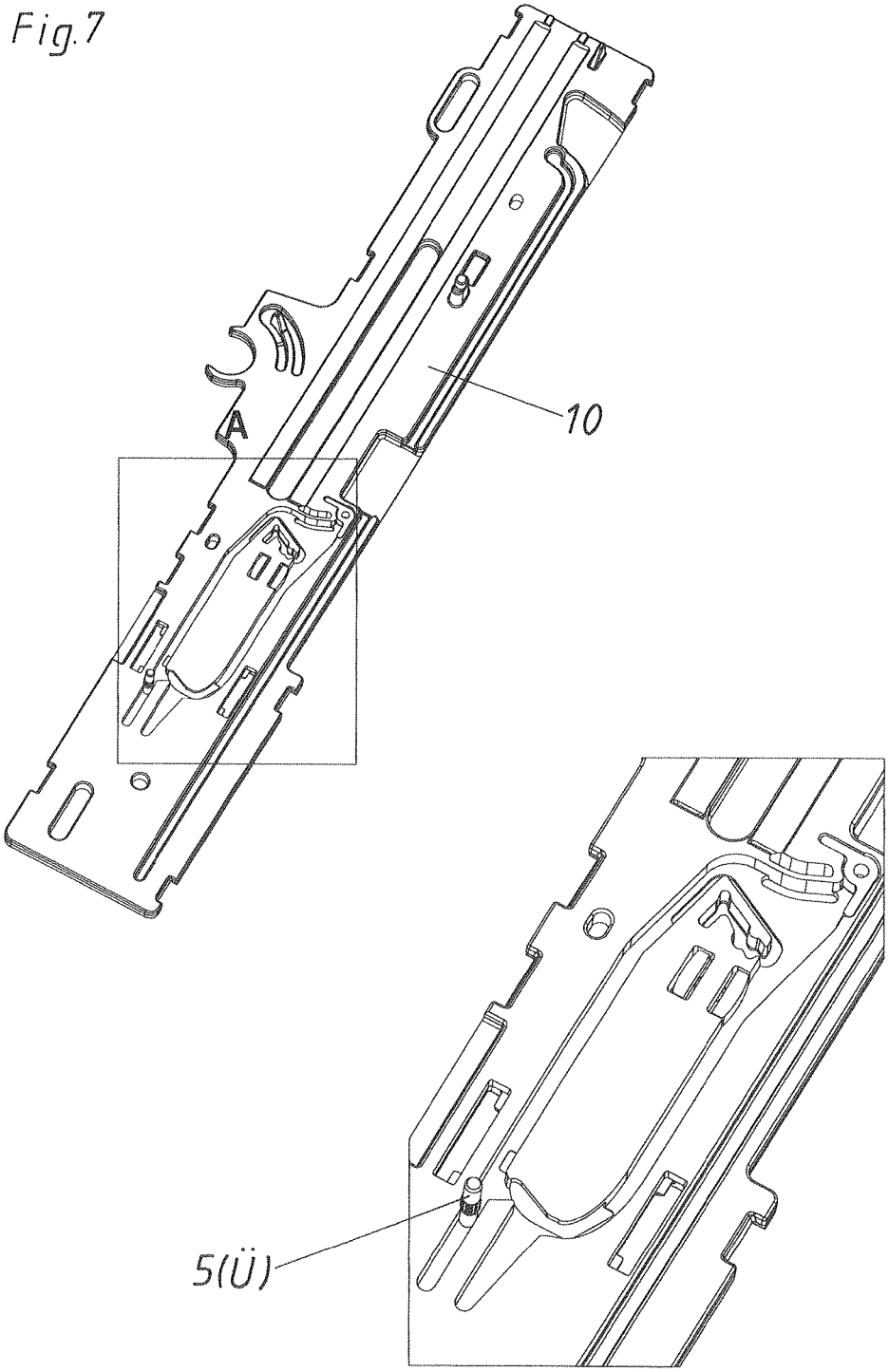
FIG. 7 shows a top view and a perspective illustration respectively of the control element in different sections of the sliding guide path.
Figure 8A:
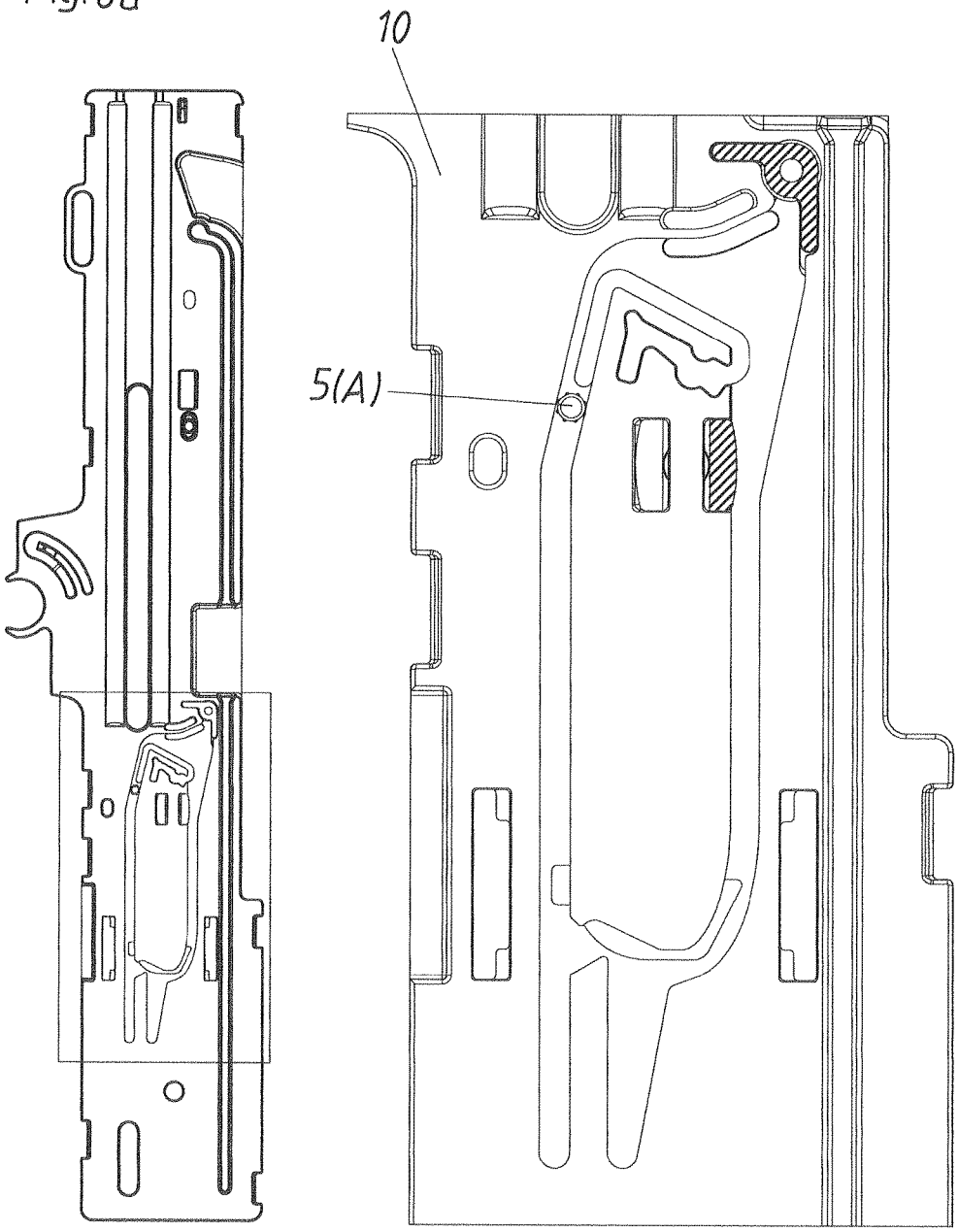
FIG. 8*a* shows a top view and a perspective illustration respectively of the control element in different sections of the sliding guide path.
Figure 8B:
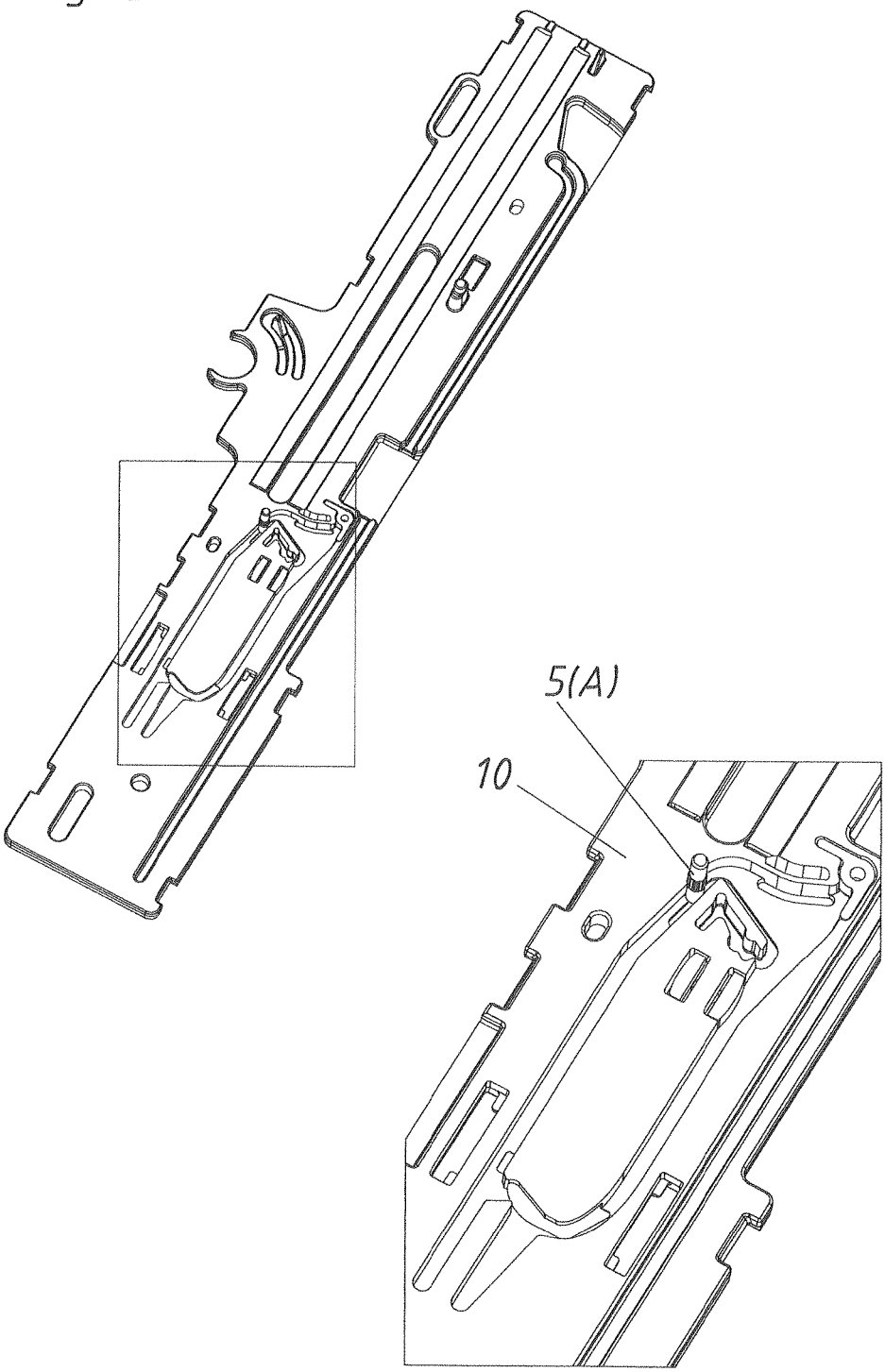
FIG. 8*b* shows a top view and a perspective illustration respectively of the control element in different sections of the sliding guide path.
Figure 9A:
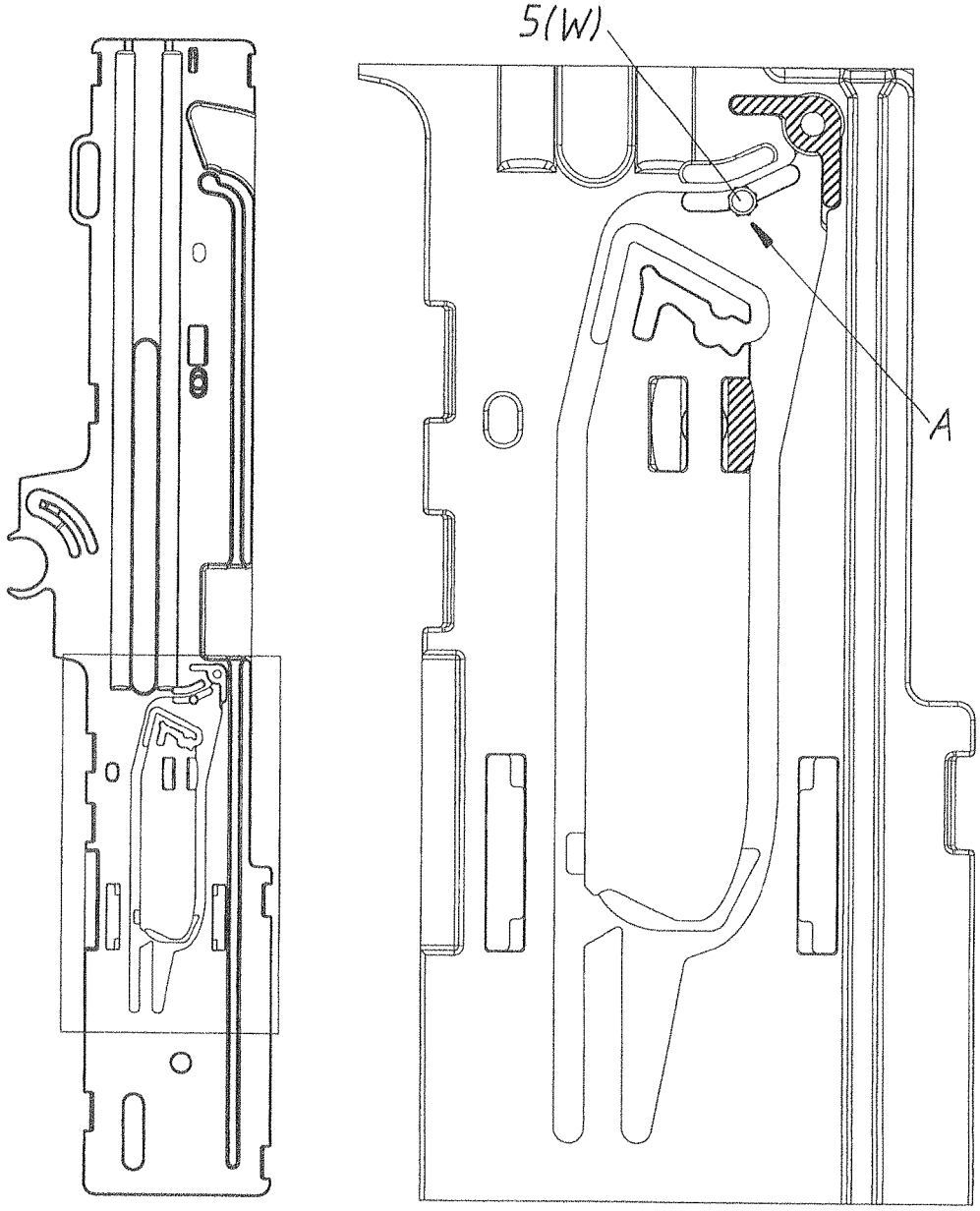
FIG. 9*a* shows a top view and a perspective illustration respectively of the control element in different sections of the sliding guide path.
Figure 9B:
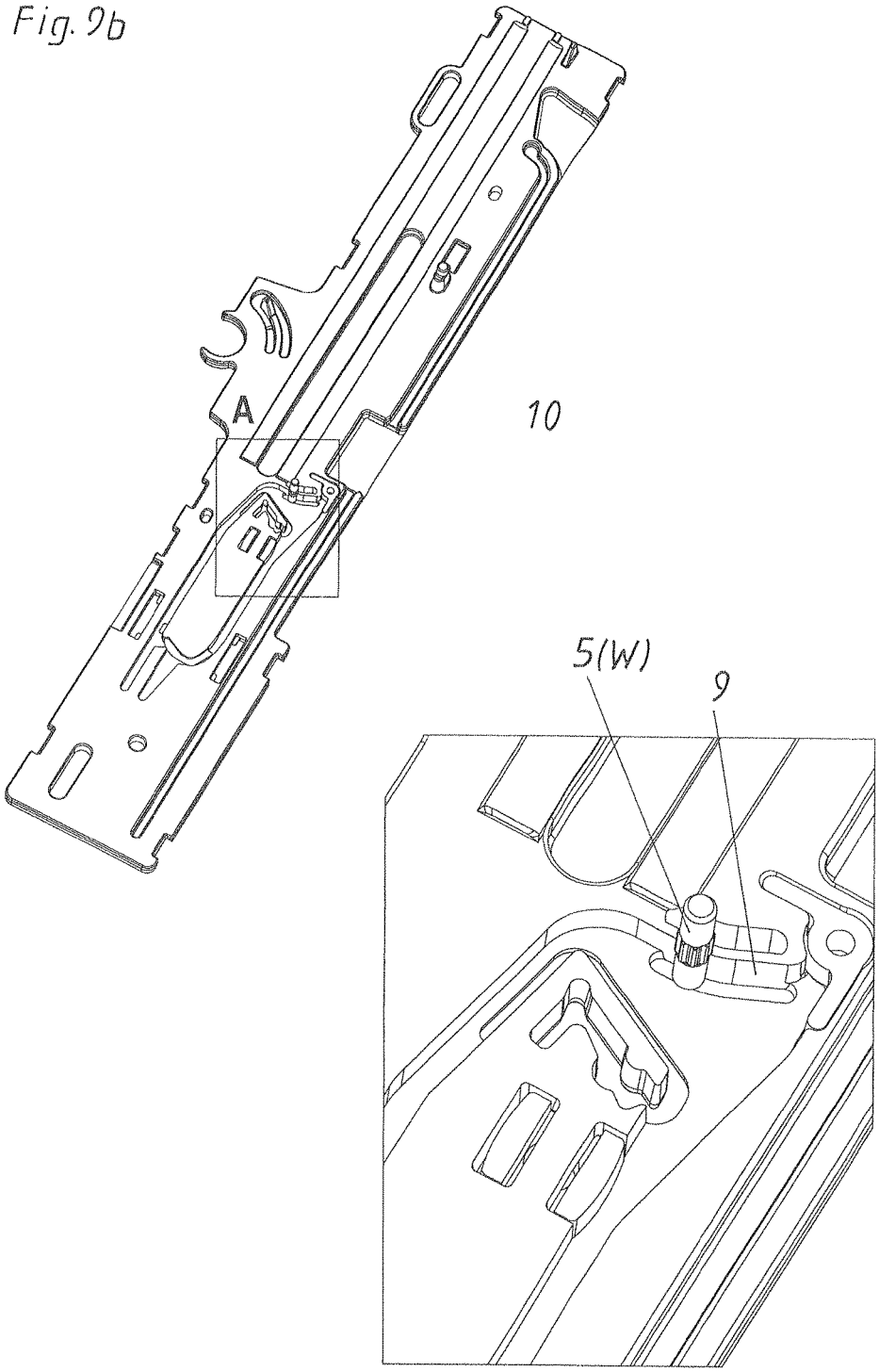
FIG. 9*b* shows a top view and a perspective illustration respectively of the control element in different sections of the sliding guide path.
Figure 10A:
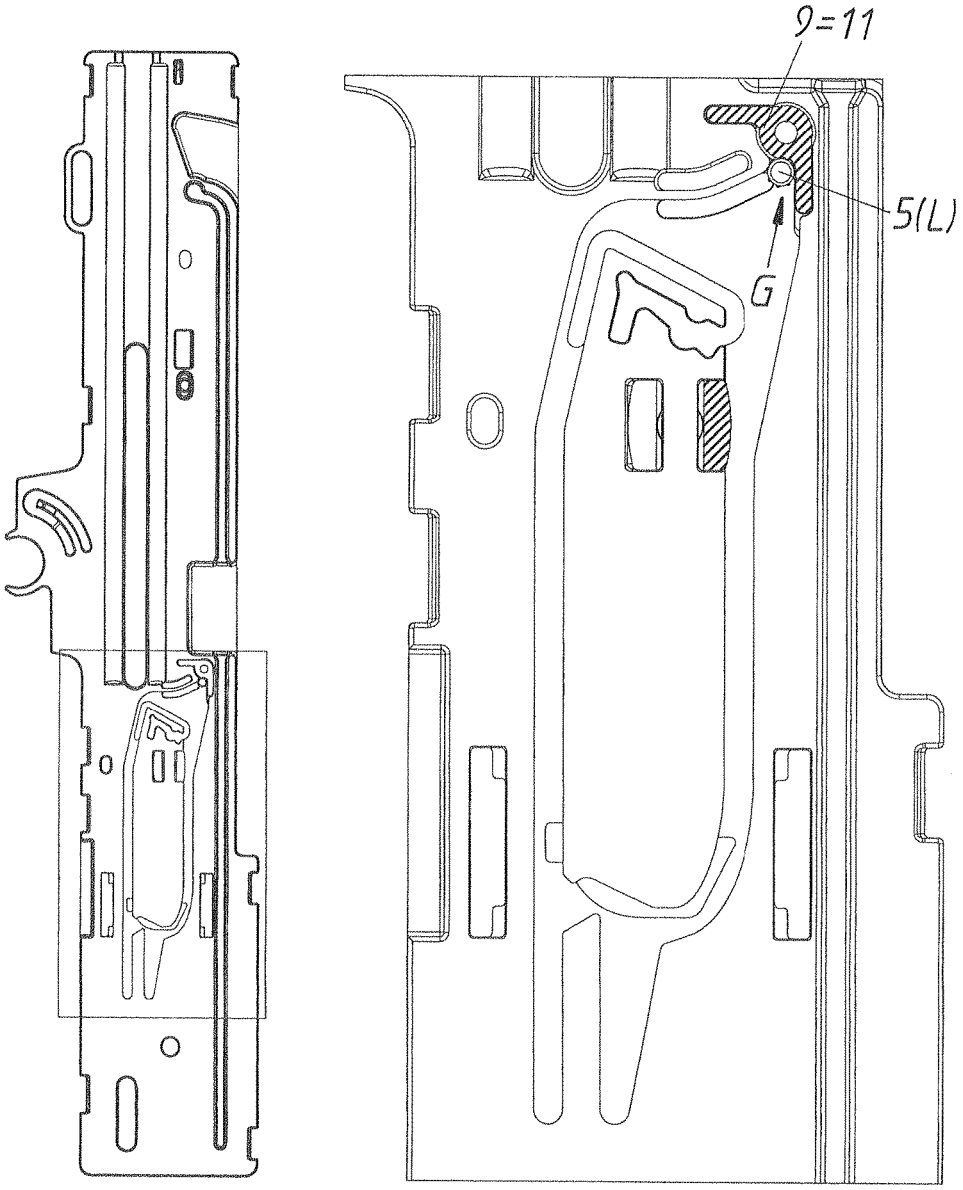
FIG. 10*a* shows a top view and a perspective illustration respectively of the control element in different sections of the sliding guide path.
Figure 10B:
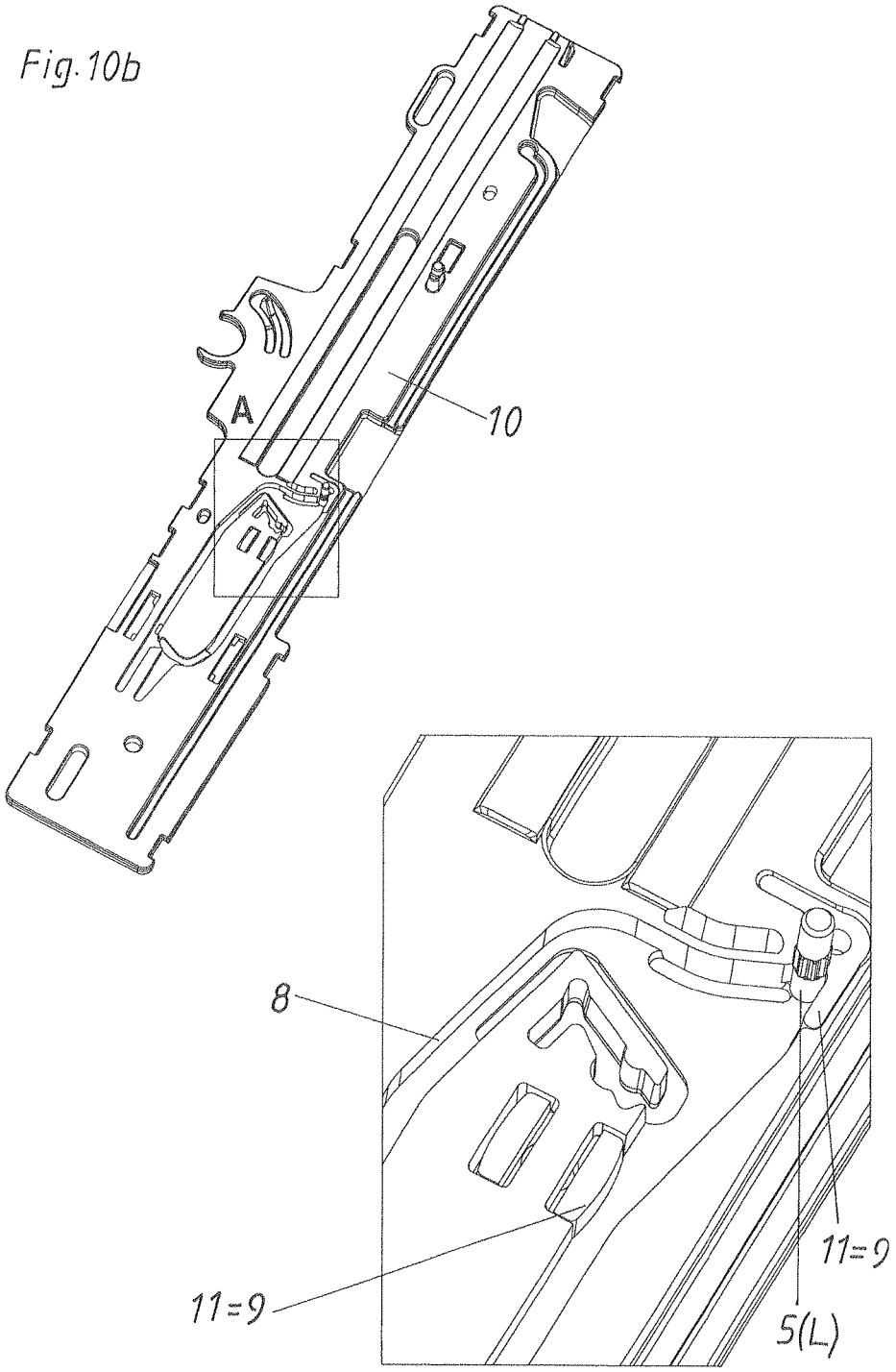
FIG. 10*b* shows a top view and a perspective illustration respectively of the control element in different sections of the sliding guide path.
Figure 11:
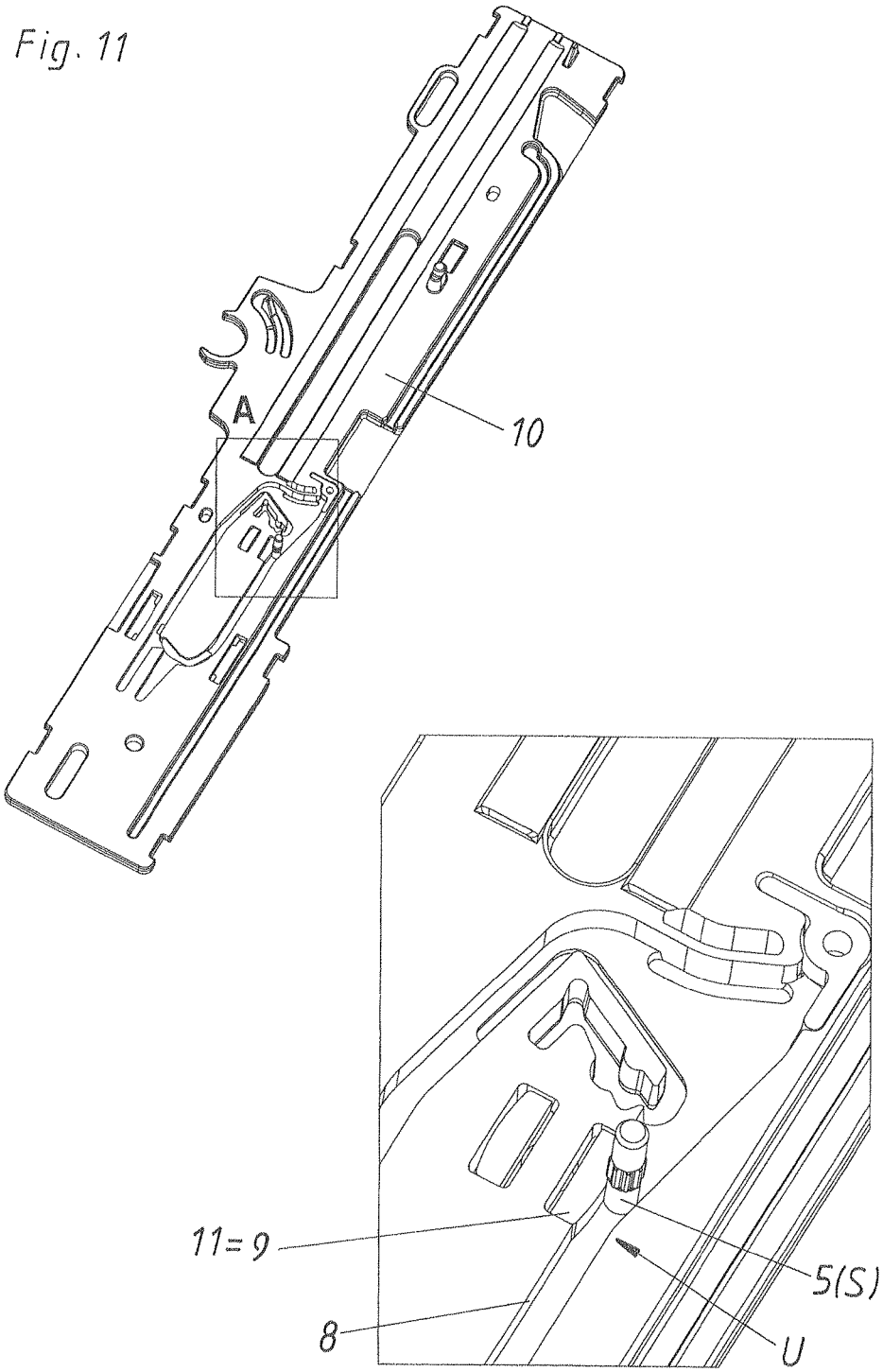
FIG. 11 shows a top view and a perspective illustration respectively of the control element in different sections of the sliding guide path.
Figure 15A:
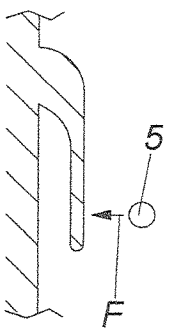
FIG. 15*a* shows a schematic comparison of differently formed hard and soft sidewall regions.
Figure 14A:
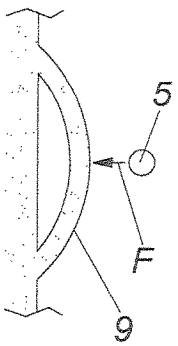
FIG. 14*a* shows a schematic comparison of differently formed hard and soft sidewall regions.
Figure 13A:
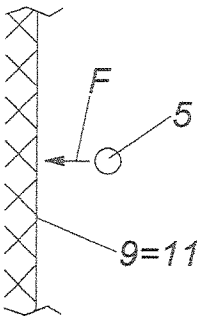
FIG. 13*a* shows a schematic comparison of differently formed hard and soft sidewall regions.

Apposite to FIG. 5, FIG. 6 shows a perspective view of the carrier 10 together with the control element 5, wherein the control element 5 is located in the latching section R. In order to avoid confusion in FIG. 5, it is shown in FIG. 6 in which section or areas of the sliding guide path 6 the impact areas G and the deflection areas U are located. Thus, exactly in the areas G and U, known for their high noise development, the soft sidewall regions 9 are provided.

In FIGS. 7 to 11 the route of the control element 5 through the sliding guide path 6 is graphically visualized. According to FIG. 7 the control element 5 is located in the over-pressing section Ü of the sliding guide path 7. The ejection force storage means 13 can relax as soon as the manual pressure onto the movable furniture part 2 ceases, whereby the control element 5 moves into the ejecting section A according to FIGS. 8*a* and 8*b*. At the end of the ejecting section A the control element eventually arrives in the shifting section W according to the FIGS. 9*a* and 9*b*. The impact on the sidewall of this shifting section W is partly absorbed or damped by the soft sidewall region 9. Subsequently, the control element 5 often arrives with still quite a large impetus in the bearing section L, wherein the impact in the bearing section L is cushioned by the sidewall region 9 consisting of a rubber-elastic material. Therefore, a lower noise development is given in these impact areas G. In the subsequent tensioning of the ejection force storage means 13 according to FIG. 11, the control element 5 is moved through the tensioning section S. The noise development in the deflection area U is reduced by the soft sidewall region 9 consisting of a rubber-elastic material.

Figure 12A:
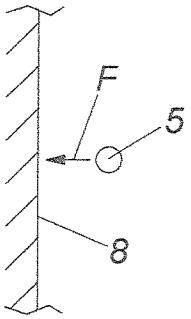
FIG. 12*a* shows a schematic comparison of differently formed hard and soft sidewall regions.
Figure 15B:
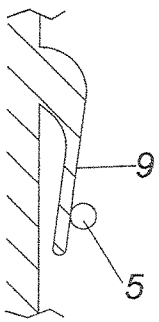
FIG. 15*b* shows a schematic comparison of differently formed hard and soft sidewall regions.
Figure 14B:
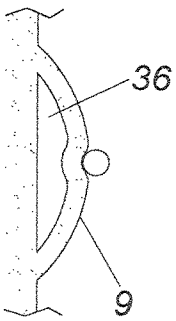
FIG. 14*b* shows a schematic comparison of differently formed hard and soft sidewall regions.
Figure 13B:
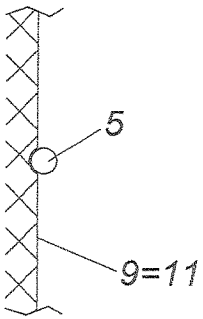
FIG. 13*b* shows a schematic comparison of differently formed hard and soft sidewall regions.
Figure 12B:
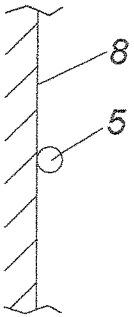
FIG. 12*b* shows a schematic comparison of differently formed hard and soft sidewall regions.

FIGS. 12*a* to 15*b* show a schematic comparison of differently formed sidewall regions and the effect of these sidewall regions in the case of an impact of the control element 5 with the same impact energy F. In FIG. 12*a* the control element 5 is shown before the impact on the hard sidewall region 8. The impact energy depends on the velocity, on the impact angle and on the force of the force storage means (ejection force storage means 13) acting on the control element 5. As illustrated in FIG. 12*b*, the hard sidewall region 8 does not yield (or only minimally yields) when impacting, whereby the noise development is relatively high. According to FIG. 13*a* the control element 5 is moved with the same impact energy F into the direction of the soft sidewall region 9 in the form of an overlay 11. When impacting according to FIG. 13*b* the impact energy is at least partly absorbed by the deformation of the soft sidewall region 9. Thus,—in contrast to the hard sidewall region 8—the surface is deformed compared to the unloaded state in FIG. 13*a*. So, the impact energy F is at least partly converted into a deformation of the soft sidewall region 9, for what reason the noise development is lower. The same applies for the soft sidewall regions 9 according to the FIGS. 14*b* and 15*b*. A surface deformation occurs when the control element 5 impacts with the same impact energy F. This is reached based on the geometric conditions (thin-walled sidewall region 9 and the recess 36 which is remote from the control element). As illustrated well in the FIGS. 12*b* to 15*b*, in each variant of the soft sidewall regions 9 there is a higher penetration depth of the control element 5 into the surface of the sliding guide path 6 compared to the hard sidewall region 8.

Summarizing, the present invention thus is about the noise damping in a heart curve (sliding guide path 6) of a Touch Latch-mechanism (drive device 1). Function load shifts or switch points of the control peg (control element 5) occur within the heart curve during the opening and closing movements of a furniture fitting with an ejection. All of these points in a heart curve lead to more or less loud noises. In order to prevent or reduce these noises, these points in the heart curve are formed by soft parts and damping elements respectively (soft sidewall regions 9) or by specifically formed wall thicknesses which allow a yielding.

The invention claimed is:

1. A drive device for a movable furniture part, comprising:

a force-actuated ejection element for ejecting the movable furniture part from a closed position into an open position;

a locking device for locking the force-actuated ejection element in a locking position, wherein the locking device comprises:

a control element, which is connected to the force-actuated ejection element; and a corresponding overlay member;

a carrier, including a sliding guide path for the control element, and a recess in which the corresponding overlay member is received, wherein the sliding guide path includes:

a bearing section;

a tensioning section; and a first sidewall region, wherein the corresponding overlay member defines a second sidewall region, wherein the first sidewall region has a different degree of hardness than the second sidewall region, the second sidewall region is positioned at one of a first surface of the carrier in a first area of the carrier adjacent to the bearing section of the sliding guide path, and a second surface of the carrier in a second area of the carrier adjacent to the tensioning section of the sliding guide path, and wherein the recess is defined by two lateral side regions connected by one longitudinal side region, the one longitudinal side region of the recess being longer than each of the two lateral side regions of the recess, wherein the one longitudinal side region of the recess is parallel to a longitudinal wall of the sliding guide path, wherein the two lateral side regions of the recess directly abut the longitudinal wall of the sliding guide path, wherein the corresponding overlay member has a projection with two lateral side surfaces and two longitudinal side surfaces, the two longitudinal side surfaces of the projection being longer than the two lateral side surfaces of the projection, wherein a first of the two longitudinal side surfaces of the projection faces the one longitudinal side region of the recess and a second of the two longitudinal side surfaces of the projection defines the second sidewall region, and wherein the corresponding overlay member is sized to fit inside the recess.

2. The drive device according to claim 1, wherein the carrier is made of plastic, and the first sidewall region is at least partly made of the plastic of the carrier.

3. The drive device according to claim 2, wherein the carrier has an elastic modulus between 1.000 and 20.000 MPa.

4. The drive device according to claim 2, wherein the force-actuated ejection element is mounted so as to be linearly displaceable at the carrier.

5. The drive device according to claim 1, wherein the second sidewall region is made of a rubber-elastic material.

6. The drive device according to claim 1, wherein the second sidewall region has a hardness between 40 and 95 shore type A.

7. The drive device according to claim 1, wherein the sliding guide path has a deflection area and an impact area for the control element, and the second sidewall region is in the deflection area or the impact area.

8. The drive device according to claim 1, wherein the sliding guide path has a latch recess, and the control element is configured to abut the latch recess in the locking position of the locking device.

9. The drive device according to claim 1, wherein the sliding guide path further comprises a latching section defined by a latch recess, an over-pressing section with a deviating slant, an ejecting section, and a shifting section.

10. The drive device according to claim 9, wherein only the one of the first surface of the carrier in the first area of the carrier adjacent to the bearing section of the sliding guide path, and the second surface of the carrier in the second area of the carrier adjacent to the tensioning section of the sliding guide path has the second sidewall region.

11. The drive device according to claim 1, wherein the force-actuated ejection element is force-actuated by an ejection force storer, which is fixed, on a first end, to the carrier and, on a second end, to the force-actuated ejection element.

12. The drive device according to claim 1, wherein the control element is positioned on a control lever which is movably mounted to the force-actuated ejection element.

13. The drive device according to claim 1, wherein the locking device is unlockable by over-pressing the movable furniture part in an over-pressed position, the over-pressed position being located behind the closed position.

14. The drive device according to claim 1, further comprising a retracting device for retracting the movable furniture part from the open position in a closing direction into the closed position.

15. An article of furniture with a furniture carcass, a movable furniture part movably mounted to the furniture carcass and the drive device of claim 1.

16. A drive device for a movable furniture part, comprising:

a force-actuated ejection element for ejecting the movable furniture part from a closed position into an open position; and a locking device for locking the force-actuated ejection element in a locking position, wherein the locking device comprises:

a control element, which is connected to the force-actuated ejection element; and a carrier, including a sliding guide path for the control element, a first recess, and a second recess, wherein the sliding guide path includes:

a shifting section;

a first sidewall region; and a second sidewall region, the second sidewall region being a wall including opposite ends, a first side, and a second side opposite the first side, and being positioned in a first area of the carrier adjacent to the shifting section and having a predetermined thickness, wherein the opposite ends of the wall are fixed, respectively, to different portions of the first sidewall region, the first recess is closer to the first side of the wall than to the second side of the wall, and the second recess is closer to the second side of the wall than to the first side of the wall, wherein each of the first recess and the second recess are apertures that extend completely through a thickness of the carrier from an upper side of the carrier to a lower side of the carrier.

17. The drive device according to claim 16, wherein the predetermined thickness of the second sidewall region is below 0.6 mm.

18. The drive device according to claim 16, wherein the second sidewall region is formed in one piece with the carrier.

19. A drive device for a movable furniture part, comprising:

a force-actuated ejection element for ejecting the movable furniture part from a closed position into an open position;

a locking device for locking the force-actuated ejection element in a locking position, wherein the locking device comprises:

a control element, which is connected to the force-actuated ejection element;

a corresponding overlay member; and a carrier, including a sliding guide path for the control element, and a recess in which the corresponding overlay member is received, wherein the sliding guide path includes:

a latch recess, the control element being configured to abut the latch recess in the locking position of the locking device;

a bearing section;

a tensioning section; and a first sidewall region, wherein the corresponding overlay member defines a second sidewall region, wherein the first sidewall region has a different degree of hardness than the second sidewall region, the second sidewall region is positioned at one of a first surface of the carrier in a first area of the carrier adjacent to the bearing section of the sliding guide path, and a second surface of the carrier in a second area of the carrier adjacent to the tensioning section of the sliding guide path, wherein a side of the corresponding overlay member defines a final corner area of the sliding guide path, the final corner area being positioned at an area of the sliding guide path which is farthest from the latch recess of the sliding guide path, and wherein the corresponding overlay member is sized to fit inside the recess.

20. A drive device for a movable furniture part, comprising:

a force-actuated ejection element for ejecting the movable furniture part from a closed position into an open position;

a locking device for locking the force-actuated ejection element in a locking position, wherein the locking device comprises:

a control element, which is connected to the force-actuated ejection element;

a corresponding overlay member; and a carrier, including a sliding guide path for the control element, and a recess in which the corresponding overlay member is received, wherein the sliding guide path includes:

a bearing section;

a tensioning section; and a first sidewall region, wherein the corresponding overlay member defines a second sidewall region, wherein the first sidewall region has a different degree of hardness than the second sidewall region, the second sidewall region is positioned at one of a first surface of the carrier in a first area of the carrier adjacent to the bearing section of the sliding guide path, and a second surface of the carrier in a second area of the carrier adjacent to the tensioning section of the sliding guide path, wherein the corresponding overlay member abuts a wall of the carrier on a side which is remote from a contact area with the control element, the wall of the carrier having a greater degree of hardness than the corresponding overlay member such that the corresponding overlay member is compressed between the wall of the carrier and the control element, and wherein the corresponding overlay member is sized to fit inside the recess.

* * * * *